United States Patent [19]

Duerr et al.

[11] 4,203,679

[45] May 20, 1980

[54] PRINT HEAD CONTROL

[75] Inventors: Jonathan H. Duerr, Wargrave; Antony C. Twitchen, High Wycombe, both of England

[73] Assignee: Trend Communications Limited, London, England

[21] Appl. No.: 837,417

[22] Filed: Sep. 28, 1977

[30] Foreign Application Priority Data

Sep. 30, 1976 [GB] United Kingdom ..... 40569/76

[51] Int. Cl.[2] ..... B41J 19/00

[52] U.S. Cl. ..... 400/320; 400/124; 400/317; 400/322; 318/87

[58] Field of Search ..... 400/124, 126, 317, 317.1, 400/320, 322, 323; 318/87, 88; 346/75, 139 A; 74/218, 220

[56] References Cited

U.S. PATENT DOCUMENTS

| | | | |
|---|---|---|---|
| 3,218,529 | 11/1965 | Evans et al. | 318/87 X |
| 3,236,351 | 2/1966 | Fitch et al. | 400/323 |
| 3,244,955 | 4/1966 | Turner et al. | 318/87 X |
| 3,891,077 | 6/1975 | Sauerbrunn | 400/124 |
| 4,075,636 | 2/1978 | Galetto et al. | 400/124 X |
| 4,076,111 | 2/1978 | Robinson et al. | 400/124 |

*Primary Examiner*—Ernest T. Wright, Jr.
*Attorney, Agent, or Firm*—Alexis Barron

[57] ABSTRACT

A printer for printing characters on paper supported adjacent a path along which a print head can be traversed. Two servo-motors are mounted adjacent the path and each connected to the head by a toothed belt. Control means connects the servo-motors in one of two modes: in the first, one servo-motor is energized to pull the head on a printing traverse while the other servo-motor is connected as a dynamic brake; and in the other, the other servo-motor is energized to pull the head on a fly-back traverse while the other servo-motor idles. To stop the head either in a printing traverse or at the end of a fly-back traverse, the mode of connection of the control means is reversed.

20 Claims, 6 Drawing Figures

PRINT HEAD CONTROL

BACKGROUND OF THE INVENTION (a) Field of the Invention

This invention relates to a printer, and in particular to a printer having a head capable of imprinting characters on to paper—or a like medium—suitably supported adjacent a path along which the head is traversed to print a line of characters.

(b) Description of the Prior Art

The head in a printer of the aforesaid type may take one of several forms. For example, the head may be a generally spherical element provided with characters at known positions on the spherical surface, the element being mounted for both rotating and tilting movement to align a required character with the paper, whereafter the head is driven on to the paper to imprint the character thereon. Another type of head has a disc or "daisy wheel" with characters either around the rim of the disc or on the ends of the "petals" (or spokes) of the wheel, the disc or wheel being rotated to bring a required character to lie adjacent the paper. A hammer, forming a part of the head, is located on the opposite side of the paper to the disc or wheel and is traversed therewith; at each character location, when the required character on the disc or wheel faces the paper, the hammer strikes the paper to drive it on to the character, thereby leaving an impression thereon. In yet another type of head, a plurality of needles are arranged in a substantially vertical line (relative to the paper) and are fired electro-magnetically into contact with the paper in accordance with a preselected pattern for any particular character, a pre-set number of vertical lines being used to make up any given character. Typically, seven needles are used, there being a maximum of five vertical lines per character—that is, the character is made up from a $7\times5$ matrix. Another array often used is a $13\times10$ matrix. A modification of this type of head uses electrostatic discharge needles and a heat-sensitive paper, a charge being given to the required needles to burn a mark on the paper at the required position so as to build up a character.

In all the above forms of printer, the head is traversed across the paper as a line of print is made up. This is usually effected by means of a servo-motor fed with appropriate signals and winding a cord fastened to the head against a spring force; the fly-back traverse to the start of a line is then achieved by the action of the spring, when the servo-motor is let free.

When printing speeds are increased, considerable difficulties arise in printing the characters exactly where required. For high speed isochronous operation, the characters can be printed "on the fly"—i.e. without stopping the traverse of the head, but when operating in the stop/start mode, the inertia of the head becomes a serve problem. From rest, when a character is to be printed, the head must be accelerated to a high speed in case a second character rapidly follows the first, but if no second character immediatly follows, the head instantly must be stopped. The inertia prevents very high accelerations and decelerations being obtained, and this in turn leads to unequally-spaced characters—which makes the print commercially unacceptable. Similarly, when a line is finished and the head has to perform the fly-back traverse, the first character of the next line must fall immediately below that of the line above, but the positioning of the head is difficult because of inertia.

A ragged left-hand margin often occurs because the head position for the first character of a line is defined by a stop for the head, but at high speeds the head inevitably bounces from the stop to some extent at the end of the fly-back traverse.

OBJECT OF THE INVENTION

It is a primary object of this invention to provide a printer in which the traversing of a print head can be controlled to give a relatively uniform character spacing even at relatively high printing speeds. It is another object of the invention to provide a printer which can print uniformly and reliably on both stop/start data and on isochronous data.

A further object of the invention is to provide a printer which employs low-powered servo-motors which are thus easy to drive, leading to lower costs.

SUMMARY OF THE INVENTION

In accordance with these and other objects of this invention, there is provided in a printer having a print head arranged to be traversable along a path and capable of imprinting characters on to paper—or like medium—suitably supported adjacent said path the improvement comprising providing first and second servo-motors mounted adjacent said path along which the head is traversed, a flexible tension element coupling the head to each servo-motor whereby driving said first servo-motor pulls the head along a printing traverse and driving said second servo-motor pulls the head along a fly-back traverse and control means for said first and second servo-motors, the control means having two connection modes in the first of which said first servo-motor is energized to pull the head on the printing traverse and said second servo-motor is connected as a dynamic brake, and in the second of which said second servo-motor is energized to pull the head on the fly-back traverse and said first servo-motor idles at least for the greater part of the fly-back traverse.

BRIEF DESCRIPTION OF THE DRAWING

Other objects and advantages of this invention will become apparent from the following detailed description, referring to the drawing, in which.

DESCRIPTION OF THE PREFERRED EMBODIMENTS

Figure 1:
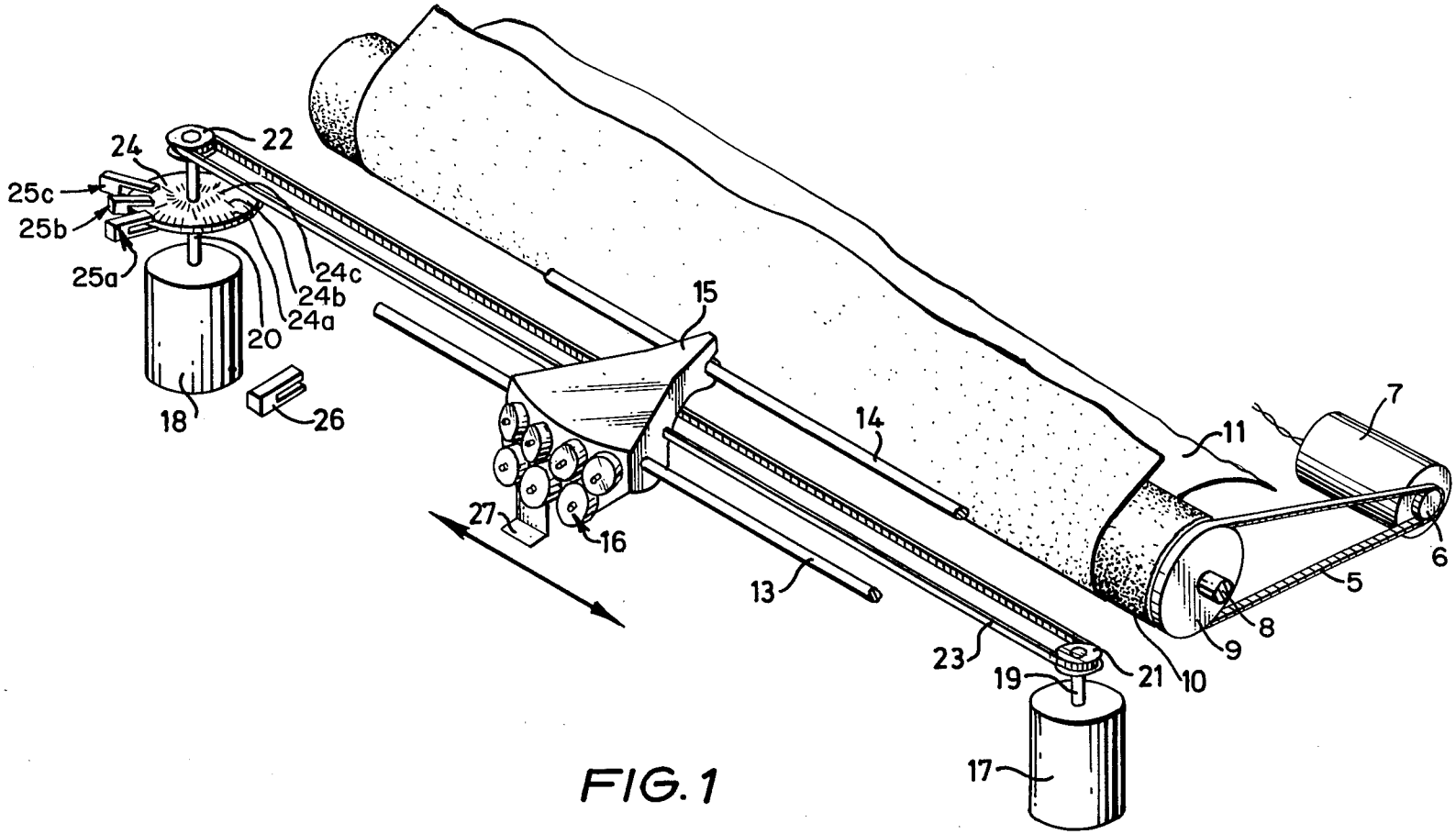
FIG. 1 is a diagrammatic view of part of a printer constructed in accordance with this invention.

In the printer of this invention, the driving of the head is shared by two servo-motors, one for each direction of movement, the two servo-motors preferably being one at each end respectively of the path. This means smaller servo-motors can be used than otherwise would be the case, allowing the control means to be simpler and able to feed lower powers. Also, the head can be mounted to have as low friction as possible (because when printing in the stop/start mode arresting of the head is achieved positively, by energizing the other servo-motor, rather than by friction and a spring force), so the starting torque required from the first servo-motor need only be low. In turn, this means a small and simple servo-motor can be used. Further difficulties in obtaining a spring for the fly-back traverse and which has a relatively uniform spring rate for very large strains is avoided.

In a preferred embodiment of a printer of this invention the flexible tension element comprises a toothed belt passing aroung toothed pulleys on the two servo-motor output shafts the ends of which belt being anchored to the head so as to form a loop. In this way, rotation of the first servo-motor in one sense will pull the head along the printing traverse, and rotation of the second servo-motor in the opposite sense will pull the head along the fly-back traverse.

The control means is preferably arranged to connect a resistive load across the terminals of the second servo-motor when that motor serves as a dynamic brake. The value of the resistive load conveniently can be substantially equal to the d.c. resistance of that servo-motor for the servo-motor may then provide a tacho-generator output for a purpose to be described below.

When the head is to be stopped during a printing traverse—for instance, if operating in the stop/start mode—the control means advantageously is arranged to remove the power from the first servo-motor pulling the head, to disconnect the resistive load from the second servo-motor and then to energize the second servo-motor so that a positive, active braking effect is obtained. As soon as the head is stopped, the power must be removed from the second servo-motor for otherwise the head would start to move again, but on a fly-back traverse.

In addition to serving as a dynamic brake during the printing traverse, the second servo-motor preferably also provides a tacho-generator output which is used for velocity control of the first servo-motor when pulling the head. It is found that a particularly advantageous form of velocity control is obtained when the tacho-generator output is fed to a comparator which compares the d.c. tacho-generator output—which is substantially proportional to the rotational rate of the other servo-motor—with a relatively high frequency triangular waveform, the output of the comparator being used to drive the first servo-motor pulling the head. By arranging the triangular waveform from the oscillator to have a period which is much shorter than the response time of the servo-motor, the effective drive to the servo-motor is a mean d.c. level, though it is in fact made up of a rectangular waveform of a relatively high frequency. Such a control means can yield excellent control characteristics, which are quite satisfactory so far as the commercial acceptability of the resultant print is concerned.

As mentioned above, on the fly-back traverse the first servo-motor imposes no significant load at least for the greater part of the fly-back travel, but it is preferred for the first servo-motor to be energized by the control means so as positively to arrest the movement of the head at the end of the fly-back traverse prior to the starting of a new line of print. If required, prior to energizing the first servo-motor, it may be connected for a short period as a dynamic brake, at the commencement of the stopping sequence of the head. However, in the preferred embodiment of printer of this invention, the control means is arranged to initiate the fly-back traverse by applying power to the second servo-motor whilst leaving the first servo-motor open-circuit. The head is thus rapidly accelerated to a very high speed and traversed along the fly-back path very quickly by the second servo-motor. At a pre-set distance from the end of the fly-back travel, the control means preferably removes the power supply from the second servo-motor whilst energizing the first servo-motor so as rapidly to arrest the movement of the head. The position of the head on the fly-back traverse at which the power is removed from the second servo-motor and applied to the first servo-motor is conveniently detected by means of an optical sensor providing an output to the control means when the head reaches the first position.

Though the head could largely be arrested by the first motor being energized but with the head striking a suitable abutment or stop at the left-hand margin finally to determine the precise position of the first character of a line of print, it is preferred for the head to moved past the left-hand margin position before finally stopping. When a new character is to be printed, the head is advanced in the direction of the printing traverse by the first servo-motor pulling the head to the point at which the first character at the left-hand margin is to be printed. In this way, a particularly neat and accurate left-hand margin can be provided, for all the difficulties associated with bounce of the head from an end stop or abutment are eliminated.

It clearly is necessary for an indexing arrangement to be provided so that the first character of a line may be printed precisely at the required position when the head is being advanced from the rest position after a fly-back traverse. One possible arrangement would be for there to be an optical sensor for the head itself and which provides an output to the control means to allow printing to commence when the head is at the correct position. However it is preferred for there to be an optical encoder mounted on the shaft of one of the two servo-motors and in co-operation with optical sensors to provide a digital encoding of the head position to the control means. Thus, the optical encoder should have sufficient resolution so as to be able to provide a unique output of each character, or for each character column in the case of a dot-matrix printer head. However, if the motor shaft makes more than one revolution on the printing traverse, the encoder may more simply provide a unique output for each character or character column position encountered on one revolution of the servo-motor shaft.

By appropriately connecting the control means to the output from the optical encoder, it is also easy to provide other desirable features on a printer of this invention, such as tabulation references and end-of-line indications.

Referring to FIG. 1, there is shown diagrammatically part of a printer embodying a head driving arrangement in accordance with this invention. The printer comprises a platen roller 10 around which paper 11 passes, the platen 10 being suitably mounted with its axis horizontal and a power feed arrangement having a drive motor 7 that drives platen 10 by means of a belt 5 entrained on pulleys 6 and 9 that are mounted on the output shaft of the motor 7 and the shaft 8 of platen 10 respectively, for advancing the paper 11 as and when necessary. A pair of rails 13 and 14 extend parallel to the axis of the platen 10, and the rails 13 and 14 supporting a printing head 15 such that the head 15 may be traversed across the paper 11, parallel to the axis of the platen 10.

The printing head 15 is of a known construction, having seven print needles arranged in a substantially vertical line, there being seven solenoids 16 one associated with each print needle respectively so that the needles selectively may be fired into contact with the paper 11 by energizing one or more of the solenoids 16. Characters are built-up by positioning the head 15 at five closely adjacent positions across the paper 11, and firing at each of those positions the required needles to build-up the character on a 7×5 dot-matrix. Such printing heads and the associated control arrangements for firing the needles to build-up characters are well-known and form no part of this invention.

Two servo-motors 17 and 18 are positioned one adjacent each end of the platen 10, the shafts 19 and 20 respectively of the servo-motors 17 and 18 being vertical and supporting toothed pulleys 21 and 22 respectively. A toothed belt 23 passes around the pulleys 21 and 22, the free ends of the belt 23 being connected to the head 15 on opposed sides thereof such that the belt 23 is in the form of a closed loop. Motor shaft 20 also supports an optical encoder disc 24 having three concentric encoding rings or slots 24*a, b* and *c*, there being three optical couplers 25*a, b* and *c* arranged to sense the encoding rings 24*a, b* and *c* on the disc 24. An additional optical coupler 26 is provided adjacent servo-motor 18, this optical coupler 26 sensing movement of a blade 27 mounted on the head 15 passing through the coupler 26.

A suitable control arrangement (described below) is provided to make the necessary connections to the servo-motors 17 and 18, and to receive the signals from the optical couplers 25 and 26 as well as from the source drive for the printer, so as to make the head 15 perform the required movement.

It will be appreciated that, in FIG. 1, movement of the head 15 from left to right is the printing traverse on which characters are printed on the paper 11, and movement from right to left is the fly-back traverse when the head 15 moves back to start a new line of printing. Normally, during the fly-back traverse the platen 10 is rotated through a pre-set angle to advance the paper 11 for the commencement of a new line of print. During the printing traverse, servo-motor 17 is energized by the control arrangement to pull the head 15 whilst servo-motor 18 serves as a dynamic brake, and during the fly-back traverse, servo-motor 18 is energized so as to pull the head to the left, with servo-motor 17 initially open-circuit but then being energized to arrest the head during the last part of the fly-back traverse, after the optical coupler 26 has provided an output when blade 27 passes thereacross.

Figure 2:
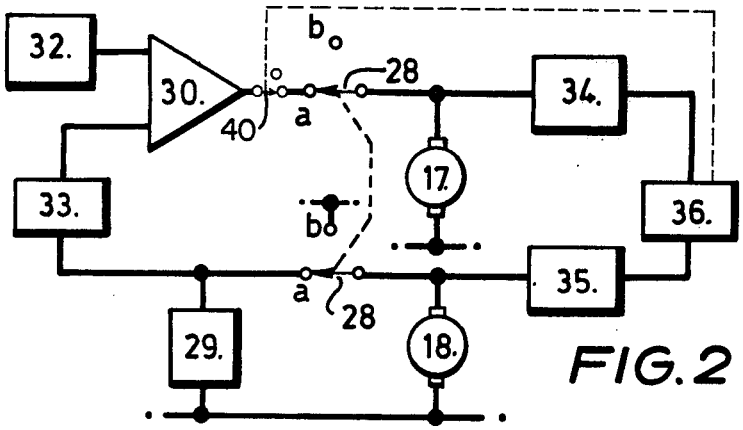
FIG. 2 is a functional block diagram of the control arrangement for the printer shown in part in FIG. 1.

Referring now to FIG. 2, there is shown the functional block diagram of the control arrangement of the printer described above. The control arrangement includes an electronic switch 28 having two positions; in position 'a' the head 15 is either being tranversed during printing or being braked towards the end of a fly-back traverse and in position 'b' the head 15 is either being traversed in the fly-back mode or being braked in a printing traverse when operating in the stop/start mode. Load 29 is connectible across servo-motor 18 for dynamic braking whilst giving a d.c. tacho-generator output directly proportional to the speed of rotation of the servo-motor 18. The tacho-generator output is added to an adjustable bias source 33 and fed to the non-inverting input of a comparator and amplifier 30, a 15 kHz triangular waveform generated by oscillator 32 being supplied to the inverting input of the comparator/amplifier 30. The comparator/amplifier 30 provides the driving current for the servo-motor 17. Two zero-speed sensing circuits 34 and 35 are provided for motors 17 and 18 respectively, control circuit 36 responding to outputs from the circuits 34 and 35 to operate the switch 28, and to operate an inhibit switch 40 to maintain the head 15 stationary once it has stopped after braking.

Figure 3A:
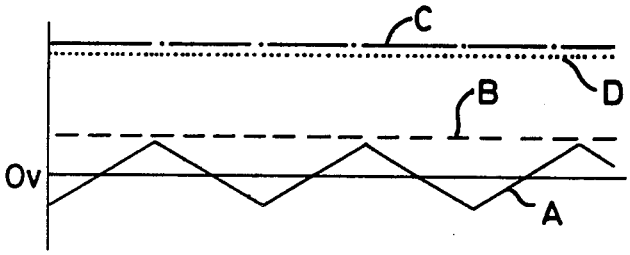
FIGS. 3(*a*) to (*c*) are waveform diagrams of the control arrangement respectively when the head is about to start moving, the head commences to move, and the head is moving at high speed.
Figure 3B:
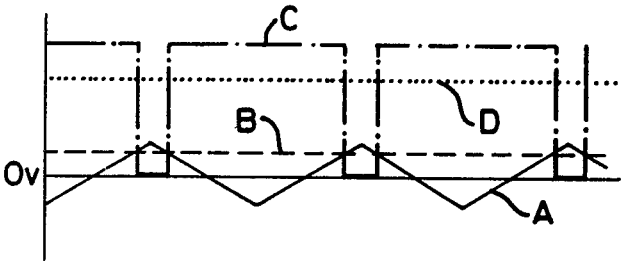
Figure 3C:
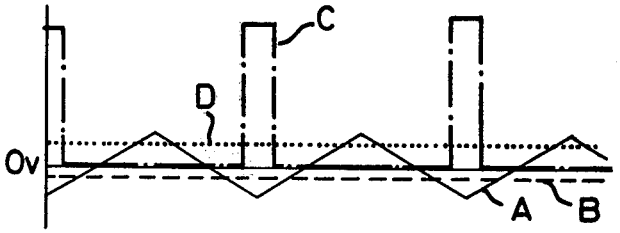

Referring now to FIGS. 3(*a*) to (*c*), waveform A represents the triangular oscillator 32 output, varying uniformly about zero volts. The bias source 33, provided for the servo-motor 18 when operating as a tacho-generator, is set so that the input fed to the non-inverting input of the comparator/amplifier 30 has a d.c. level very slightly higher than the peak level of the triangular waveform A; because the motor 18 when operating as a tacho-generator is stationary and there is no output voltage in FIG. 3(*a*), the bias voltage itself is represented by B. Waveform C represents the comparator/amplifier output, which is a relatively high level d.c. voltage; the mean servo-motor drive is then also a d.c. volatage shown by waveform D. Provided the head 15 actually is to be moved, the control arrangement ensures the comparator/amplifier 30 output is fed to the servo-motor 17, which thus starts to accelerate rapidly. If the head 15 were not to be moved, either the comparator output would be inhibited or the comparator/amplifier 30 would be turned off by the control arrangement.

As the head 15 starts to pick up speed, the tacho-generator output rises and the voltage supplied to the non-inverting input of the comparator/amplifier 30 falls. Thus, the output from the comparator/amplifier 30 becomes a rectangular waveform C the mark/space ratio of which depends upon the rotational rate of the tacho-generator, and the mean servo-motor drive D (being the average value of the rectangular waveform) falls (FIG. 3(*b*)). As the head 15 picks up speed to a high value, the output from the tacho-generator is high, so the input to the non-inverting input of the comparator/amplifier 30 is low. The output from the comparator/amplifier 30 now is a rectangular waveform C with a relatively short "on" time, so that the average value of this rectangular waveform C is small and the mean servo-motor drive D is also small. It will be appreciated that this form of servo control is a closed-loop system and provided that the triangular waveform A has a period considerably shorter than the response time of the servo-motor 17, a smooth and precise form of velocity control is obtained.

During the above cycle of operation, servo-motor 18, in addition to serving as a tacho-generator, also serves as a dynamic brake for the head 15. This is obtained by the control arrangement connecting a resistive load 29 across the terminals of the servo-motor 18, the resistance of the load 29 being equal to the static d.c. resistance of the servo-motor 18 so as to obtain maximum power transfer to the load 29, if the inductance of the motor 18 is ignored. Though this reduces the effective tacho-generator output, it is found that sufficient output is still available for successful operation of the servo-system—typical tacho-generators having outputs of the order of 7 to 8 millivolts per revolution per minute.

The optical encoder disc 24 together with the three associated optical couplers 25*a, b* and *c* provides a digital output of the head position. The center coupler 25*b* is used to detect "first column in character" slots 24*b* in the encoder disc 24, whereas the other two couplers 25*a* and 25*c* are used to detect "column" slots 24*a* and 24*c* in the encoder disc 24, there being seven columns per character. The encoder disc 24 contains 84 "column" slots 24*a*, 24*c* and 12 "first column in character" slots 24*b*, so 12 characters can be printed per revolution of the servo-motor shaft 19. The direction of rotation could be detected as well if required by the encoder disc 24 and couplers 25*a–c*.

In operation, servo-motor 17 pulls the head 15 via the belt 23 during the printing traverse, with servo-motor 18 connected as a dynamic brake and also providing a tacho-generator output. This has the additional advantage of allowing a relatively small static belt tension to be used, for the drag of servo-motor 18 in itself eliminates backlash which might otherwise be caused through a slack belt 23. If the printer is operating in the stop/start mode, the load 29 is disconnected from servo-motor 18 and power is applied thereto approximately at the mid-point of a character being printed if the next character does not follow immediately, and the arrangement is such that the head 15 can then be stopped within the space of half a character. When the next character is to be printed, the velocity control described with reference to FIGS. 2 and 3 is such that the head 15 is accelerated and stopped again in the space of one character. On the other hand, if the printer is operating in the continuous mode, all the printing is effected on the fly and the velocity control ensures the characters are regularly and unformly spaced.

At the end of a printing traverse, the control arrangement disconnects the load 29 from the servo-motor 18 and instead supplies power thereto so that servo-motor 18 will pull the head 15 back to the left-hand end of the platen 10. Initially, motor 17 is left open-circuit, but as soon as the optical coupler 26 provides an output, power is disconnected from servo-motor 18 and is supplied instead to servo-motor 17. The head 15 is thus rapidly arrested, though the head 15 does not come to rest until it has passed the left-hand margin of the print-out. When the next character is to be printed, servo-motor 17 is once more energized with servo-motor 18 connected as a dynamic brake and the head 15 is advanced to the required position for the first character of the new line (i.e. the left-hand margin), which position is determined by the optical coupler 26 in conjunction with the optical encoder disc 24, the center optical coupler 25*b* reading out the position of the head 15.

Figure 4:
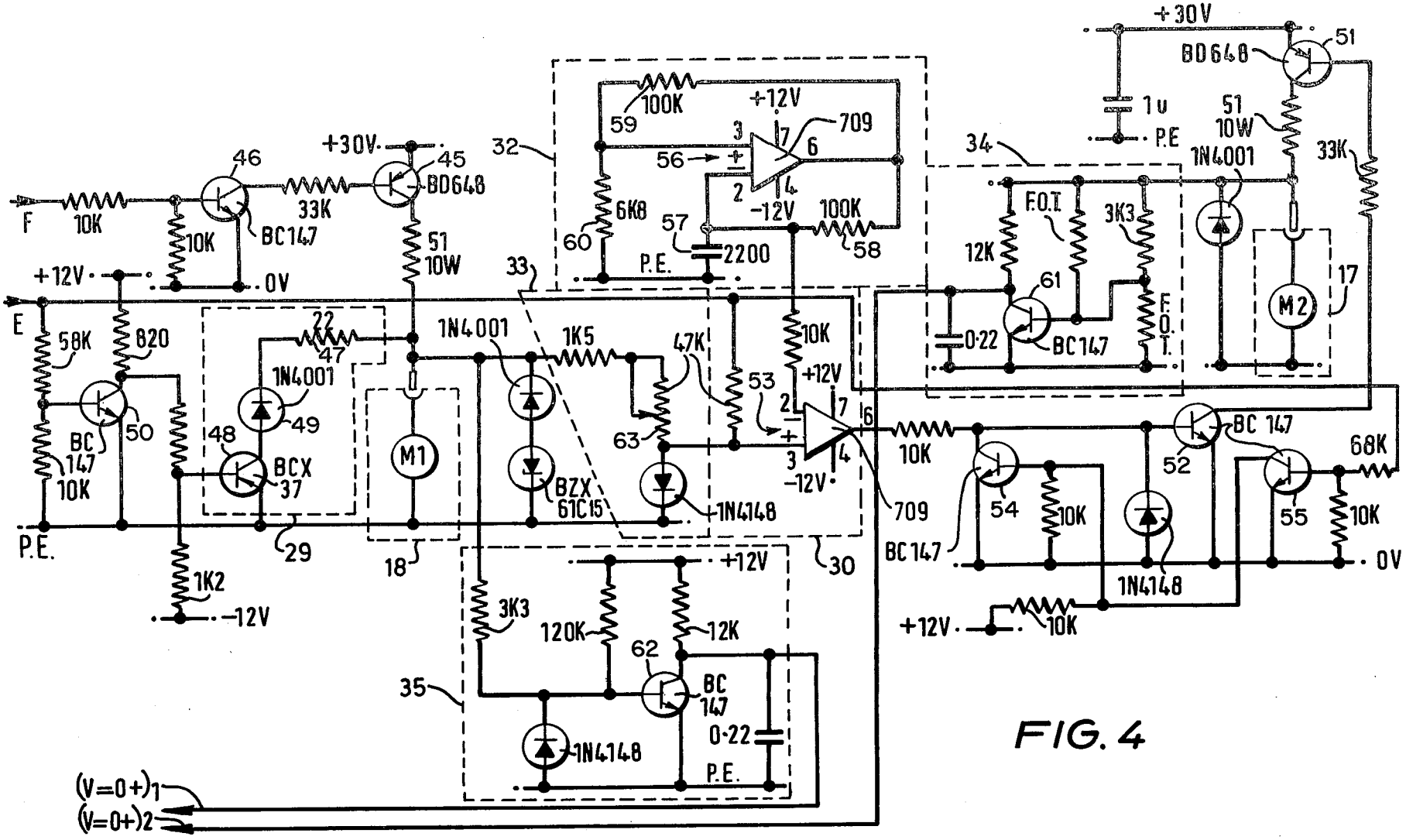
FIG. 4 is a circuit diagram of the control arrangement shown diagrammatically in FIG. 2.

Referring now to FIG. 4, there is shown the circuit diagram of the control means of FIG. 2. As can be seen, the circuit conveniently is divided into the elements of FIG. 2 enclosed in chain lines and given the same reference characters.

It can be seen that current to servo-motor M1 (18) is switched by a transistor 45, the base of this transistor 45 being driven by transistor 46. A high input at F thus causes current to flow through the motor M1. The motor M1, however, is braked by connecting a 22-ohm resistor 47 across its terminals by means of switching transistor 48, protected by diode 49, these components serving as load 29. The transistor 48 is rendered conducting when there is no input at point E so that transistor 50 is turned off.

Current to servo-motor M2 (17) is switched by a transistor 51, the base of this transistor 51 being driven by transistor 52. When a high output is obtained from comparator 53, this is transferred to the base of transistor 52 to render transistor 51 conducting and hence supply current to the motor M2. Irrespective of the output from the comparator 53, if transistor 54 conducts, transistor 52 remains off and motor M2 cannot be driven. Transistor 54 conducts unless a high signal is present at point E, turning on transistor 55. This arrangement forms the inhibit switch 40.

The comparator 53 forms the active element of the comparator and amplifier block 30, which receives a tacho-generator signal from motor M1 after that signal has had added thereto an appropriate bias in block 33. The bias can be pre-set by means of a 47K ohm variable resistor 63 included in block 33. The tacho-generator signal, with bias added, is fed to the non-inverting input (pin 3) of the comparator 53, the inverting input (pin 2) receiving the oscillator signal from oscillator 32. This is a conventional form of relaxation oscillator constructed around an operational amplifier 56, including a timing capacitor 57, feedback resistor 58, and bias-setting resistors 59 and 60 for the non-inverting input (pin 3).

Both motors M1 and M2 are connected to zero-detecting circuits 35 and 34 respectively, which are similarly configured and provide outputs $(V=0+)1$ and $(V=0+)2$ respectively. Each of the circuits 34 and 35 include a transistor 61 and 62 respectively appropriately biased so that when the associated servo-motor stops rotating, the output from the circuit rises suddenly.

Drive for the printer is derived for instance from a keyboard or a computer-controlled transmission, the drive being decoded to operate the print needles of the print head 15 in association with movement of the head 15. An input to terminal 'E' causes motor 17 to be energized to pull the head 15 on a printing traverse, whereas an input to terminal 'F' causes motor 18 to be driven to pull the head 15 on a fly-back traverse. No input on terminal 'E' or 'F' maintains the head 15 stationary. The zero-sensing circuits 34 and 35 are used to turn off an input to terminal 'E' or 'F' at the precise moment the head 15 stops when the head 15 is being braked. Thus, for the four modes of operation:

Printing traverse—Drive 'E'
Fly-back traverse—Drive 'F'
Braking or printing
traverse for stop/start characters—Drive 'F' until $(V=0+)_2$
Braking at end of fly-back traverse—Drive 'E' until $(V=0+)_1$

We claim:

1. In a printer having a print head arranged to be traversable along a path and capable of imprinting characters on to paper supported adjacent said path, the improvement comprising providing first and second servo-motors mounted adjacent said path along which the head is traversed, a flexible tension element coupling said head to each servo-motor whereby driving said first servo-motor pulls the head along a printing traverse and driving said second servo-motor pulls the head along a fly-back traverse, and control means having two connection modes in the first of which said first servo-motor is energized to pull the head on the printing traverse and said second servo-motor is connected as a dynamic brake, and in the second of which said second servo-motor is energized to pull the head on the fly-back traverse and said first servo-motor idles at least for the greater part of the fly-back traverse.

2. A printer as claimed in claim 1, in which said first and second servo-motors are provided one adjacent each end respectively of said path along which the head is traversed.

3. A printer as claimed in claim 1, in which each servo-motor has a shaft and in which said flexible tension element comprises a toothed belt, there being toothed pulleys on the shafts of the first and second servo-motors around which said toothed belt passes, with the ends of said belt anchored to the head so as to form a loop.

4. A printer as claimed in claim 1, in which a resistive load is provided in the control means, which resistive load is connected across said second servo-motor in said first connection mode of the control means.

5. A printer as claimed in claim 1, in which said second connection mode of the control means energizes said second servo-motor and leaves said first servo-motor open-circuit.

6. A printer as claimed in claim 1, in which in said second connection mode of the control means, said second servo-motor provides a tacho-generator output to the control means, and said control means drives said first servo-motor to pull the head along a printing traverse in dependence upon the tacho-generator output.

7. A printer as claimed in claim 1, in which a sensor is provided to detect the presence of the head at a predetermined position on a fly-back traverse, said sensor providing an output to the control means whereby the control means switches from said second connection mode to said first connection mode.

8. A printer as claimed in claim 1, in which indexing means are provided in association with one of said servo-motors, said indexing means supplying to said control means an output indicative of the head position.

9. A printer as claimed in claim 8, in which each servo-motor has a shaft in which said indexing means comprises an optical encoding disc mounted on the shaft of one of said servo-motors, there being optical sensors co-operating with said encoding disc to provide said output to the control means.

10. A printer having a platen for supporting paper to be printed, rail means extending parallel to the axis of said platen adjacent said platen, a print head slidably mounted on said rail means for printing characters on supported paper, first and second servo-motors having output shafts and mounted adjacent first and second ends of said platen, two toothed pulleys mounted one on each servo-motor output shaft, a toothed belt passing around said toothed pulleys and the ends of said belt being fastened to said head whereby energization of either servo-motor to rotate its respective output shaft traverses said head along said rail means, and control means for said servo-motors, the control means having two connection modes in the first of which said first servo-motor is energized to pull the head on a printing traverse and a resistive load is connected to said second servo-motor to act as a dynamic brake, and in the second of which said second servo-motor is energized to pull said head on a fly-back traverse, said first servo-motor being left open circuit to idle.

11. A printer as claimed in claim 10, in which an optical encoder disc is mounted on the output shaft of one of said servo-motors and optical sensors co-operate with said disc, the outputs from the optical sensors being supplied to said control means to allow setting of the head position.

12. A method of operating a printer having a print head arranged to be traversable along a path and capable of imprinting characters on to paper supported adjacent said path, there being first and second servo-motors mounted adjacent said path and each drivingly coupled to the head by a flexible tension element, and control means for the servo-motors, in which method the control means has two connection modes, in the first of which said first servo-motor is energized to pull the head along a printing traverse while the second servo-motor is connected as a dynamic brake, and in the second of which said second servo-motor is energized to pull the head along a fly-back traverse while said first servo-motor idles, stopping of the head respectively in a printing traverse and at the end of a fly-back traverse being effected by switching the control means from one connection mode to the other.

13. A method as claimed in claim 12, in which the control means connects a resistive load across said second servo-motor when the first servo-motor is energized in said first connection mode, so that said second servo-motor acts as a dynamic brake.

14. A method as claimed in claim 12, in which said second servo-motor provides a tacho-generator output to the control means on a printing traverse, said control means employing said output for velocity control of said first servo-motor.

15. A method as claimed in claim 14, in which said tacho-generator output is compared with a triangular waveform the period of which is short relative to the response time of said first servo-motor, the signal derived from the comparison being used to control the drive to said first servo-motor, thereby to effect velocity control of said first servo-motor.

16. A method as claimed in claim 12, in which an optical sensor is provided to detect the presence of the head at a predetermined position on a fly-back traverse, the optical sensor providing an output to said control means when the head is at said predetermined position, said control means switching from said second connection mode to said first connection mode on receipt of said output.

17. A method as claimed in claim 16, in which the movement of the head on a fly-back traverse is stopped after the head has moved beyond the position at which the first character of a line is to be printed and when the next character is to be printed, the head is moved on a printing traverse to the position of the first character.

18. A method as claimed in claim 17, in which an optical encoder is associated with one of the servo-motors and optical sensors are arranged to co-operate with said encoder, said sensors providing an output indicative of the head position to said control means, whereby said first servo-motor may be energized to move the head to a predetermined position.

19. A method of operating a printer having a print head arranged to be traversable along a path and capable of imprinting characters onto paper supported adjacent said path, there being first and second servo-motors mounted adjacent said path and each drivingly coupled to said head by a flexible tension element, and control means for said servo-motors, said control means having first and second connection modes for said servo-motors, in which method:

in said first connection mode a load resistor is connected across said second servo-motor, whereby said second servo-motor operates as a dynamic brake and as a tacho-generator, an oscillator generates a triangular waveform, the triangular waveform is compared with the tacho-generator output to produce a resultant signal, and said resultant signal is amplified to drive said first servo-motor; and in said second connection mode said second servo-motor is energized to drive the flexible tension element in a direction opposite to that imparted by the first servo-motor; the control means being switched to said first connection mode after operation in the second connection mode.

20. A method as claimed in claim 19, in which, in the second mode, the print head is drawn in a fly-back traverse and at the end of the fly-back traverse said control means is switched from said second connection mode to said first connection mode, whereby said head is stopped solely by said first servo-motor beyond the first character position of a line of print, whereafter, when the next character is to be printed, the head is advanced in the direction of a printing traverse to the position of the first character to allow the printing thereof.

* * * * *